United States Patent [19]

Hasson et al.

[11] 4,264,651

[45] Apr. 28, 1981

[54] METHOD FOR CALCITE COATING ON THE INNER SURFACE OF PIPES

[75] Inventors: David Hasson, Haifa; Mordechai Karmon, Petach Tikva, both of Israel

[73] Assignees: Technion Research & Development Ltd., Haifa; Mekoroth Water Co., Tel-Aviv, both of Israel

[21] Appl. No.: 61,423

[22] Filed: Jul. 27, 1979

[30] Foreign Application Priority Data

Aug. 4, 1978 [IL] Israel ..... 55280

[51] Int. Cl.[3] ..... B05D 7/22

[52] U.S. Cl. ..... 427/239; 137/1; 427/238; 427/327

[58] Field of Search ..... 427/239, 238, 327; 137/1

[56] References Cited

U.S. PATENT DOCUMENTS

| | | | |
|---|---|---|---|
| 2,015,290 | 9/1935 | Sanders | 427/239 |
| 2,299,748 | 10/1942 | Hatch | 427/239 |
| 3,640,759 | 2/1972 | Primus | 427/239 |

*Primary Examiner*—Ronald H. Smith
*Assistant Examiner*—Janyce A. Bell

[57] ABSTRACT

Disclosed is a method for obtaining a tenacious insitu coating deposition of calcite on the inner surface of water pipes. The calcite coating method according to the present invention has an advantage that it is able to maintain a completely corrosion-free system during the coating, thus assisting the formation of a protective coating of good bonding properties. The method consists in the incorporation of a reagent selected from the group consisting of alkali metal sulfite and hydrazine, in an amount which is at least the stochimetrically required to deoxygenate the aqueous solution utilized for said coating, which is supersaturated with respect to calcium carbonate having a dissolved calcium and carbonate levels of above 100 ppm. The calcite producing ingredients are supplied to the water stream in quantities supplementing concentrations available in the natural water used, giving the required supersaturation levels by addition of suitable salts. The calcite coating can be successfully applied to large diameter mains and pipes by utilizing a large recycle ratio. The coating has in particular an improved adherence on the wall of the pipes, when the water is delivered at a flow velocity of above 1.5 m/sec.

14 Claims, No Drawings

METHOD FOR CALCITE COATING ON THE INNER SURFACE OF PIPES

The present invention relates to the protection of water pipes against internal corrosion and tuberculation. More particularly, the invention relates to a method for a controlled deposition of a calcite coating on the inner surfaces of pipes.

Unlined cast iron and steel pipes suffer from internal corrosion and tuberculation, which causes significant reduction in the flow through the pipes due to the increased friction and leakages. Furthermore, the presence of corrosion products may lead to difficulties such as objectionable coloring, odor or taste. By cleaning these pipes it has been found that the pipes capacity can be restored for a certain period of time. However, the removal of the corrosion products accelerates the corrosion of newly exposed inner surfaces. For this reason, various coatings have been proposed to protect the cleaned pipe. Coating materials that have been suggested include cement, bituminous compositions and epoxy resins. Cement lined pipes are over 100 years old. A patent for cement lined metal pipes was issued in 1843 and actually applied to a wrought-iron water supply line in 1845. However, for renovation of old pipes, cement as well as other proposed linings require relatively expensive procedures due to the substantial labor and time consuming operations involved.

The present invention is more related to in situ lining of a pipe by a suitable calcium carbonate coating and, therefore, some specific prior publications will be incorporated herein by references. R. F. McCauley described in his reviews (Water & Sewage Works, July 1960, 276–281, Journal AWWA, June 1960, 721–734) the method for applying a protective calcium carbonate coating to the inner surface of a cleaned pipe, using a controlled super-saturated solution of calcium carbonate with water passing through the pipe during the coating. In view of the supersaturation condition, calcium carbonate tends to precipitate both in bulk and on the walls of the pipes. In order to obtain useful non-soft coatings, it is imperative to maintain a sufficiently high flow velocity. However, a high flow velocity accelerates the corrosion process during the initial period of the coating operation. Thus the corrosion process competing with the calcium carbonate deposition process, consists a major difficulty since a well bonded good calcium carbonate coating cannot be developed on a corroding surface. An increase in the calcium carbonate supersaturation level will indeed favor a more rapid coating deposition and therefore will reduce the competing corrosion process, but at the same time will have a tendency to precipitate in solution calcium carbonate particles of undesirable sizes. McCauley suggested to suppress the competing corrosion process, by adding to the water a critical amount of polyphosphate and maintaining a sufficiently high flow velocity. It seems that the polyphosphate delays the bulk precipitation from the highly supersaturated solution, and acts to a certain degree as a corrosion inhibitor thus assisting the desired formation of a tenacious protective coating. However, the polyphosphate addition method suffers from the disadvantage that a critical amount of the reagent, between relatively narrow limited concentrations, must be found for each case. If the polyphosphate concentration, is too low, it will have no effect while if it is too high, it will damage the coating process. Another main disadvantage inherent to this method is that the polyphosphate only suppresses the corrosion by a physical adsorption process and is therefore incapable to abolish completely corrosion since oxygen remains in the system. A recent U.S. Patent (U.S. Pat. No. 3,640,759) describes a method for calcite lining of pipes, in the presence of polyphosphate, maintaining a flow velocity in the range of 5–8 ft./sec and incorporating an amount of 20–80 ppm cement to the solution.

It is an object of the present invention to provide a simple method for calcite lining of water pipes. It is another object of the present invention to provide a simple method for obtaining a tenacious and well-bonded calcite lining of water pipes. It is yet another object of the present invention to provide a simple method of calcite lining of water pipes wherein the interfering corrosion process is prevented thus greatly improving the quality of the coating.

The invention consists of a method for obtaining a tenacious in-situ coating deposition of calcite having a thickness of above 50 microns on the inner surface of water pipes, by delivering through said pipes at a flow velocity of above 1 m/sec an aqueous solution supersaturated with respect to calcium carbonate having a dissolved calcium level above 100 ppm, and a dissolved carbonate level above 100 ppm (expressed as $CaCO_3$), being characterized by the fact that a reagent selected from the group consisting of alkali metal sulfite and hydrazine or mixtures thereof, is incorporated in an amount which is at least the stoichiometrical required to deoxygenate said aqueous solution, the average degree of calcium carbonate supersaturation in the pipe being maintained at a level resulting in a turbidity equivalent to precipitated $CaCO_3$ having a concentration not more than that of the remaining dissolved $Ca^{++}$ or $CO_3^{--}$ ions, whichever is the smaller.

The rate of calcite deposition will of course be a function of $Ca^{++}$ and $CO_3^{--}$ concentrations in the aqueous solution and will be adversely affected by concentration losses accompanying turbidity. Precipitated calcium carbonate in the aqueous solution also adversely affect the quality of the deposit. It has been surprisingly found that the alkali metal sulfite delays the nucleation and precipitation of calcium carbonate from the supersaturated solution. Thus apart from offering the possibility of creating a tenacious bonding between the initial coating and the corrosion-free inner surface of the pipes, the sulfite presence enables to select calcium carbonate supersaturation conditions which result in an improved coating of a dense and hard nature.

The retardation effect of the alkali metal sulfite is illustrated by the following data. The pH of tap water (7.25–7.35) containing 265 to 285 ppm $Ca^{++}$ as $CaCO_3$ and a total alkalinity of 315–330 ppm, was increased by adding NaOH. At each pH level, the turbidity of the solution was measured after 5 minutes. The following results were obtained:

| $Na_2SO_3$ concentration: (in ppm) | 0 | 20 | 100 | 500 | 1000 |
|---|---|---|---|---|---|
| Critical pH: | 9.3 | 9.35 | 9.40 | 9.80 | 10.16 |

The nucleation retardation effect appears clearly from the above results which indicate the critical pH at which the turbidity-pH curve exhibited a sharp increase of turbidity with pH. By the addition of 100 ppm sodium sulfite the solution could be maintained free from turbidity for five minutes at a pH of 9.4 while by the addition of 500 ppm sulfite, the solution was free from turbidity for the same period of a pH of 9.8. This increase in critical pH represents an increase in $CO_3^{--}$ concentration of over 50%.

One of the advantages imparted to the calcite coating method according to the present invention is the fact that it is able to maintain a completely corrosion-free system during the coating, thus greatly favoring conditions for the formation of a protective coating of good bonding properties. As known in the art, prior to depositing the calcite lining in a pipe, it is necessary that the pipe be throughly cleaned to the metal and permit a good bonding between the coating and the metal surface. However, when the pipe is mechanically cleaned, in its preparation for the coating process, it may develop some corrosion when left without protection even for a short period of time. It has been found that such corrosion can be removed by circulating a sodium sulfite solution through the pipe for a period of above 30 minutes and preferably above 120 minutes before starting the coating process. It was also found that sulfite circulation affects beneficially uncleaned corroded surfaces and can significantly improve the quality of the calcite deposit formed on such surfaces.

The essential ingredients for producing a calcite coating from a supersaturated solution are a soluble calcium salt and a soluble carbonate salt or salt mixtures. When the ionic product of calcium and carbonate exceeds the solubility product, the following reaction occurs: $Ca^{++}+CO_3^{--}=CaCO_3$.

The calcite producing ingredients are supplied to the water stream, in quantities supplementing concentrations available in the natural water used and giving the required supersaturation levels, by addition of suitable salts. For example, soluble calcium is added by introducing to the water stream a solution of calcium halide, usually $CaCl_2$. Soluble carbonate is added by introducing an alkali metal carbonate, usually $Na_2CO_3$. If the natural water contains adequate amounts of bicarbonate, adjustment of the pH by alkali addition, usually NaOH, provides the necessary soluble carbonate. The pH total alkalinity relationship guides the determination of the ingredients supplied to produce the required $CO_3^{--}$ concentration, as known in the art of water conditioning. The term "calcite" will be adopted here, though the coating formed may include other crystallographic species.

The method according to the present invention can be applied at any ambient conditions. Comfortable temperature or warm weather is preferred, bearing in mind that the induction period for the formation of an initial calcite layer adhering to the metal (about ½ to 2 hours at 25° C.) will be longer the lower the ambient temperature, that deposition rates will be somewhat reduced as the ambient temperature goes down and that provision for heating the concentrated solutions fed to the water stream will be required at low ambient temperature to cope with possible crystallization of feed solutions.

The crux of the present invention which enables to obtain a tenacious improved calcite coating is the utilization of a reagent selected from the group consisting of alkali metal sulfite and hydrazine in an amount which is at least the stoichiometrically required to deoxygenate the water. Examples of alkali metal sulfites are sodium sulfite and potassium sulfite. In particular sodium sulfite is a convenient relatively inexpensive industrial reagent which does not exhibit health hazards and has no objectionable ecological aspects. It reacts easily with the oxygen present in the water according to the chemical equation: $Na_2SO_3+\frac{1}{2}O_2=Na_2SO_4$. The reaction product itself ($Na_2SO_4$) is also known as a harmless chemical compound which is generally present in natural water. The stoichiometric amount of sulfite required to react with the dissolved oxygen of ambient air saturated water (about 8 ppm) is 63 ppm. In order to ensure a sufficiently high deoxygenation rate, an excess of sulfite over the above stoichiometrically required is preferred, the amount being above 120 ppm. Also, as known in the art, the rate of the above reaction may be accelerated by the addition of a small amount of a catalyst such as $CoCl_2$, $Co(NO_3)_2$, $NiCl_2$, $Ni(NO_3)_2$ or mixtures thereof. The concentration of the sulfite stock solution is not critical and can be varied in a broad range. Generally it is in the range of 2 to 15% by wt. The concentration of the catalyst is very small as known in the art, being in the range of 0.1 to 0.6% by wt. of the amount of the alkali sulfite.

The water can be also chemically deoxygenated by the use of hydrazine which reacts with $O_2$ according to the following chemical reaction:

$$N_2H_4+O_2=N_2+2H_2O.$$

Hydrazine has the advantages that the product of the above reaction, is nitrogen which can easily be removed from the solution.

One of the requirements for carrying out the method of the present invention is to maintain a certain degree of supersaturation of the dissolved calcium and carbonate in the water. Loss of supersaturation is manifested by the turbidity incurred to the water, by the precipitated calcium carbonate particles. The precipitated calcium carbonate can be measured by chemical analysis of the total calcium and the dissolved calcium. Another practical method is to measure by optical means, the level of turbidity expressed in Jackson Turbidity Units (JTU) according to standard methods described in the chapter on Turbidity on pages 348–355 of Standard Methods (13th Edition 1971, American Public Health Association).

According to the present invention it is possible to ensure that the induction period previously mentioned will be short (less than 2 hours under usual conditions) by maintaining a turbidity level of above 4 to 6 JTU. The turbidity level during the whole coating process should not reach a high value. Apart from representing a loss of chemicals, and reducing the deposition rate of a calcite layer of useful quality, an increasing level of turbidity progressively affects the quality of the deposit, making it softer and more porous. This adverse affect of turbidity becomes more pronounced the lower the flow velocity. In order to obtain a good coating of the calcite according to the present invention the calcium carbonate should be present in a supersaturated form, above 100 ppm dissolved $Ca^{++}$ and 100 ppm $CO_3^{--}$ (as $CaCO_3$) being characterized by precipitated $CaCO_3$ having a concentration equal or less than the dissolved limiting reactant, and preferably less than one half the concentration of the dissolved limiting reactant.

Low turbidity levels are particularly simple to maintain according to the present invention when lower diameter water mains or pipes (6" diameter or below) are coated. Under such situations effluent disposal usually presents no difficulty; the water may be discarded to waste after passing once through the pipe or with a small fraction recycled. An important aspect of the present invention is that utilization of an alkali sulfite can serve the dual purpose of both completely suppressing the deleterious corrosion process by the deoxygenation effect and suppressing turbidity well below the above-mentioned preferred limit by the nucleation suppression effect.

When the calcite coating is applied to large diameter mains and pipes, the disposal of the large amount of effluent might be a problem. In this case, the method according to the present invention will be applied by utilizing a large recycle ratio, as commonly utilized in such situations.

The known other additives commonly used in water treatment such as polyphosphate based materials may be also incorporated without affecting the benefits to the coating process imparted by the sulfite. Additives such as polyphosphates may be additionally used to control turbidity. Also small amounts of cement, silicate and similar materials may be added in order to ensure complete and smooth sealing of the calcite coating.

It has been found that the coating on the pipe has in particular an improved adherence on the wall of the pipes when the water is delivered at a flow velocity of above 1 m/sec. and more preferably above 1.5 m/sec. When low flow velocities were utilized, the calcite coatings tended to be soft and porous, thus not providing the desired corrosion protection effect to the pipes.

Among the techniques used to evaluate the quality of the improved coating obtained was the cross-cut adhesion test as described by British Standard 3900, Part E6 (1974). This test procedure is known for assessing the performance of a coating by measuring a property which depends on the adhesion of the coating to the substrate. There are six steps of classification based on visual examination of the appearance of a cross-cut area of the test coating. The highest grade of adhesion, marked 0, is achieved when the edges of the cuts area are completely smooth and none of the squares of the lattice is detached. The lowest grade is 5 and represents flaking that cannot be defined even by grade 4. Grade 4 is defined by some squares have been detached partly or wholly when a cross-cut area distinctly greater than 35% but not distinctly greater than 65% is affected.

The corrosion protection of the pipes coated according to the present invention was also tested. Specimens of the coated pipe prepared according to the present invention, were evaluated by the standard method of Salt Spray (Fog) testing having the designation of ASTM: B117-73.

Specimens of various thickness coating were continuously exposed in a salt spray chamber for a period of one month. A blank specimen—without any coating—was severely corroded in less than 24 hours.

A coating of 150 microns calcite, developed one corrosion pinhole after 6 days, but this does not develop any further. Signs of corrosion began to appear only after 28 days.

A specimen of the coated pipe having about 700 microns thickness did not show any sign of corrosion during all duration of the test.

The beneficial effect of the required amount of sodium sulfite on the calcite coating, can be illustrated by two actual experiments. The conditions were substantially the same (temperature, time of experiment, thickness of the coating) except the amount of sodium sulfite. In one experiment the sodium sulfite amount was well below the stoichiometrically while in a second experiment it was well above the stoichiometrically required. It was found that in the second experiment the quality of the coating had an adhesion grade between 0–1 and a bulk density of 1.8 g/cm$^3$ while in the first experiment, the poor quality of the coating was manifested by an adhesion grade of between 3 and 4 and a bulk density of only about 0.7 g/cm$^3$.

While the invention has been described in connection with specific embodiments thereof, it will be understood that it is capable of further modifications and this patent is intended to cover any variation, uses or adaptions thereof following in general the principle of the invention and including such departures from the present disclosure as come within known or customary practice in the art to which the invention pertains and as may be applied to the essential features hereinbefore set forth and as fall within the scope of the invention. The following examples are given only for illustrating the invention without being limited thereto.

Experiments were carried out in a flow system consisting of a 2" diameter horizontal test pipe made of black iron of 13 m overall length. The pipe consisted of two sections connected by a flexible U connection. The pipe was provided with 10 equally spaced removable test specimens, consisting of segments cut from 2" pipes. Each segment was 15 cm long and 2 cm wide and was fitted to ports of similar dimensions cut at the upper face of the test pipe with an adequate sealing arrangement. The test specimens thus formed an integral part of the internal surface of the pipe. Water fed from a 1 cu.m. feed vessel was pumped by means of a circulation pump through the test pipe at a desired flow velocity and was returned to the feed vessel. A desired residence time of the water in the system was obtained by means of level control of the feed vessel and the flow rate of fresh water fed to the feed vessel and the equivalent flow rate withdrawn from the system and run to waste. Provisions were made to inject continuously various solutions to the circulating water by means of metering pumps.

The rate of deposition of the coating could be followed by removing test specimens in a programmed manner and taking measurements such as increase in weight and thickness. The nature of the coating could be qualitatively followed by visual inspection and simple scratch tests and more precisely by various techniques, including adhesion tests, chemical crystallographic and microscopic analyses, profilometric traces and density determinations. The coating obtained on the pipe itself could be also examined through the ports housing the test specimens.

As an example of the results obtained without the benefits of the sulfite method according to the present invention, the results of the following experiment are cited.

Tap water of the following composition was fed to the feed vessel ($Ca^{++}$ and Total Alkalinity (TA) expressed in ppm as $CaCO_3$): $Ca^{++}$=250 ppm, TA=320 ppm, TDS (total dissolved solids)=900 ppm, pH=7.3. Residence time in the system was 5 minutes. Flow velocity in the test pipe was 2 m/sec. A solution of 5% by wt. NaOH was injected to the pipe to provide a pH level of 8.9. The composition of the water was substantially constant throughout the pipe and analysed as follows: $Ca^{++}$=140 ppm, TA=400 ppm, precipitated calcium=100 ppm. The test specimens placed in the pipe were partly black iron specimens and partly stainless steel specimens. The experiment was run for 8½ hours and the following results were obtained:

Noticeable coating occurred after an induction period of 2 hrs. A substantial uniform layer of between 40 to 50 micron thick deposited in the specimens held in the system for the whole duration of the experiment. The stainless steel specimens provided coatings of very good quality (adhesion grade of 1) and were uniformly white and smooth. The Centre Line Average roughness (CLA) was 2 μm. On the other hand, the coatings formed on the black iron pipe specimens were of a much inferior quality, and were of a non-uniform nature. The coating formed was found by chemical analysis to contain less than 85 to 90% of $CaCO_3$, the rest being mainly iron oxides. Most of the coating had the visual appearance of a white matrix heavily tainted by the color of iron rust products. The adhesion grade was 3 to 4 and the surface texture was much rougher compared to that on the stainless steel specimen (CLA=20 μm). Some clean white patches formed on a minor part of the coated surfaces without being affected by corrosion appeared to be of much better mechanical quality.

The beneficial effect of sulfite will be illustrated by results of an experiment carried out under substantially similar conditions, except for the continuous addition of sulfite. After cleaning the pipe, tap water containing 200 to 400 ppm sulfite was circulated for about 1 hour. The coating process was then commenced by injecting a 4% solution of NaOH to provide a pH of 10. Sulfite was continuously metered to the pipe from an 8% solution containing 0.2% by wt. $Co(NO_3)_2.6H_2O$ of the amount of $Na_2SO_3$ in the solution. Other conditions were as follows: Residence time in the system=5 minutes; flow velocity=2 m/sec. Fresh feed composition was substantially as before. The composition of the water passing through the pipe analysed as follows: $Ca^{++}$=185 ppm, TA=550 ppm, pH=10, sulfite concentration=250 ppm; precipitated calcium=12 ppm.

It is seen that the addition of sulfite permitted operation at a considerably higher pH with a much lower turbidity level.

The experiment was run for 20 hours. Noticeable coating occured after an induction period of about 3 hours. All the specimens were covered by a tenacious uniformly white coating of high adhesion-grade (0 to 1). The thickness of the coating formed was about 400 micron and its bulk density was 1.8 g/cm³. The whole length of the pipe was similarly coated.

The coating rate was also markedly improved because a higher supersaturation level could be maintained and was 21 μm/hr. as compared to about 7 μm/hr. in the previous experiment.

When it is desired to separate the effect of turbidity from the corrosion prevention effect it is possible to use hydrazine, which was found according to the present invention not to possess any turbidity suppression effect. Hydrazine has also been found to affect beneficially uncleaned corroded surfaces and can significantly improve the quality of the calcite deposit formed on such surfaces.

Although hydrazine is known as a much slower oxygen scavenger than alkali metal sulfite at low temperatures, it is possible to increase its reaction rate by incorporating small amounts of catalysts such as active carbon, hydroquinone etc., as known in the art.

The beneficial effect by hydrazine according to the present invention, was tested in a similar experiment like that with alkali metal sulfite. An amount of 150 ppm of uncatalyzed hydrazine was utilized together with sodiummetapolyphosphate, the latter in a concentration in the range of 0.5–5 ppm to suppress the bulk precipitation. The experiment was run for 60 hours. Noticeable coating occured after an induction period of about 2 hours. All the specimens were covered by a tenacious uniformly white coating of high adhesion (grade 0 to 1). The thickness of the coating under the optimal concentration of the sodium meta-polyphosphate was about 360 microns, its bulk density being over 2.3 g/cm³.

In a similar manner mixtures of alkali sulfite and hydrazine, with or without sodium metapolyphosphate, or with or without catalysts can also be utilized, according to the procedure described in the present invention. A person skilled in the art will select the reagents mentioned above according to the facilities available.

I claim:

1. A method for obtaining a tenacious in situ coating deposition of calcite having a thickness of above 50 microns on the inner surface of water pipes by delivering through said pipes at a flow velocity of above 1 m/sec. an aqueous solution supersaturated with respect to calcium carbonate consisting of a soluble calcium salt and soluble carbonate salt having a dissolved calcium level about 100 ppm and a dissolved carbonate level of above 100 ppm (expressed as $CaCO_3$), being characterized by the fact that a reagent selected from the group consisting of alkali metal sulfite and hydrazine or mixtures thereof is incorporated in an amount which is at least the stoichiometrically required to deoxygenate said aqueous solution, the average degree of calcium carbonate supersaturation in the pipe being maintained at a level resulting in a turbidity equivalent to precipitated $CaCO_3$ having a concentration not more than that of the remaining dissolved $Ca^{++}$ or $CO_3^{--}$ ions, whichever is the smaller.

2. A method according to claim 1, wherein the amount of alkali metal sulfite incorporated in the aqueous solution is above 100 ppm.

3. A method according to claim 1, wherein the alkali metal is selected from sodium or potassium.

4. A method according to claim 1, wherein the calcium carbonate in the aqueous solution is formed in situ from added streams of a soluble calcium salt and a soluble carbonate salt or salt mixtures, with alkali addition to control pH.

5. A method according to claim 1, wherein the pipe is cleaned, then treated with said reagent to clean the pipe from residual corrosion for a period of above ½ to 2 hours prior to the in-situ calcite coating.

6. A method according to claim 4, wherein the streams added are composed of calcium chloride, sodium hydroxide and sodium carbonate.

7. A method according to claim 1, wherein the pH during calcite deposition is in the range of 9 to 10.5.

8. A method according to claim 1, wherein the average turbidity in the pipe resulting from precipitated calcium carbonate from the supersaturated said aqueous solution is at a concentration less than one half the concentration of the remaining dissolved $Ca^{++}$ or $CO_3^{+}$ ions, whichever is the smaller.

9. A method according to claim 1, wherein the flow velocity of said aqueous solution is above 1.5 m/sec.

10. A method according to claim 1, wherein catalysts are incorporated in the said reagents utilized for deoxygenating the aqueous solution.

11. A method according to claim 10, wherein said catalysts utilized with alkali metal sulfite are selected from the group consisting of $CoCl_2$, $Co(NO_3)_2$, $NiCl_2$, $Ni(NO_3)_2$ or mixtures thereof.

12. A method according to claim 1, carried out at ambient temperatures.

13. A method according to claim 1, wherein additives for suppressing the calcium carbonate bulk precipitation are incorporated in the water solution circulated during the calcite deposition.

14. A method according to claim 1, wherein small amounts of cement or silicates are also incorporated.

* * * * *